United States Patent [19]

Pomerantz

[11] 4,121,433

[45] Oct. 24, 1978

[54] MEANS FOR SENSING FROST ACCUMULATION IN A REFRIGERATION MECHANISM

[75] Inventor: Daniel I. Pomerantz, Lexington, Mass.

[73] Assignee: P.R. Mallory & Co. Inc., Indianapolis, Ind.

[21] Appl. No.: 762,678

[22] Filed: Jan. 26, 1977

[51] Int. Cl.[2] ..... F25D 21/02

[52] U.S. Cl. ..... 62/140; 340/581

[58] Field of Search ..... 62/140, 151, 138; 340/234, 235; 324/61 R

[56] References Cited

U.S. PATENT DOCUMENTS

| | | | |
|---|---|---|---|
| 2,904,968 | 9/1959 | Spencer, Jr. | 62/140 |
| 3,282,065 | 11/1966 | Flanagan | 62/140 |
| 3,822,560 | 7/1974 | Hansen et al. | 62/151 X |
| 3,961,495 | 6/1976 | Beauvent et at. | 62/140 |

*Primary Examiner*—William E. Wayner

*Attorney, Agent, or Firm*—Hoffmann, Meyer & Coles

[57] ABSTRACT

In a refrigeration mechanism including a refrigerant, a means for pressurizing the refrigerant, a means for liquifying the refrigerant, a means for vaporizing the refrigerant, and a means for circulating air to be refrigerated, the improvement comprising a means for sensing frost accumulation which includes a capacitance sensitive element disposed within the means for vaporizing the refrigerant.

14 Claims, 4 Drawing Figures

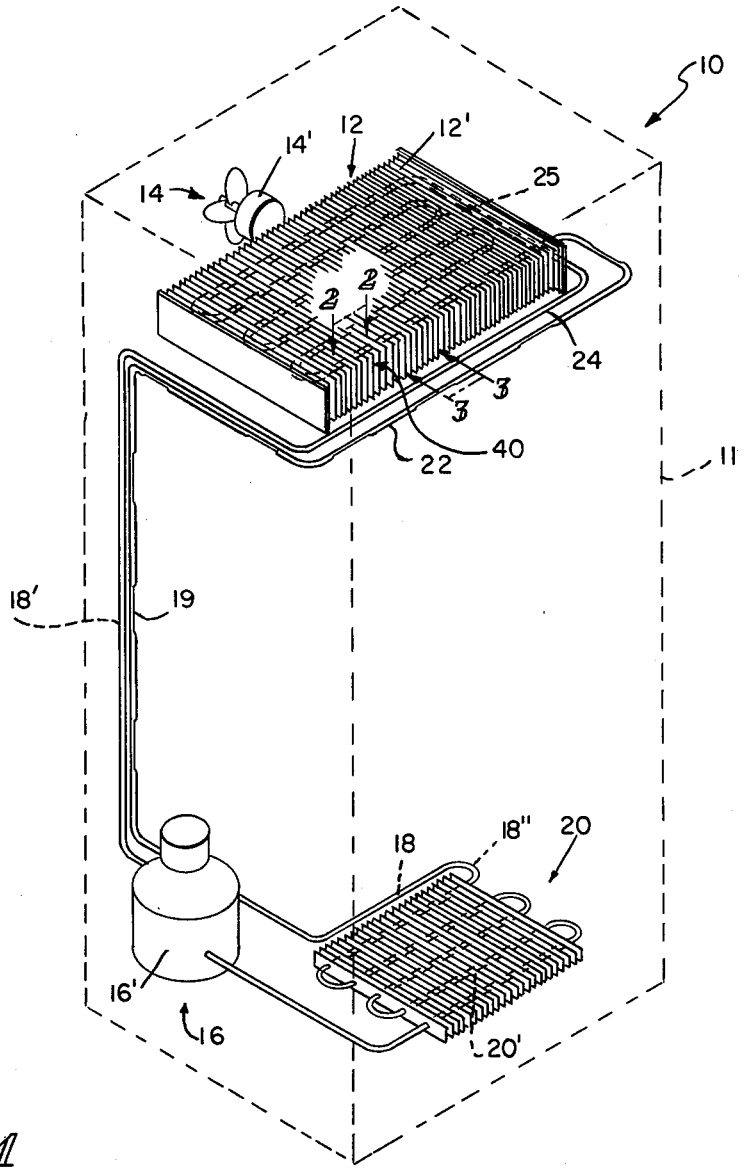
FIG. 1
FIG. 2
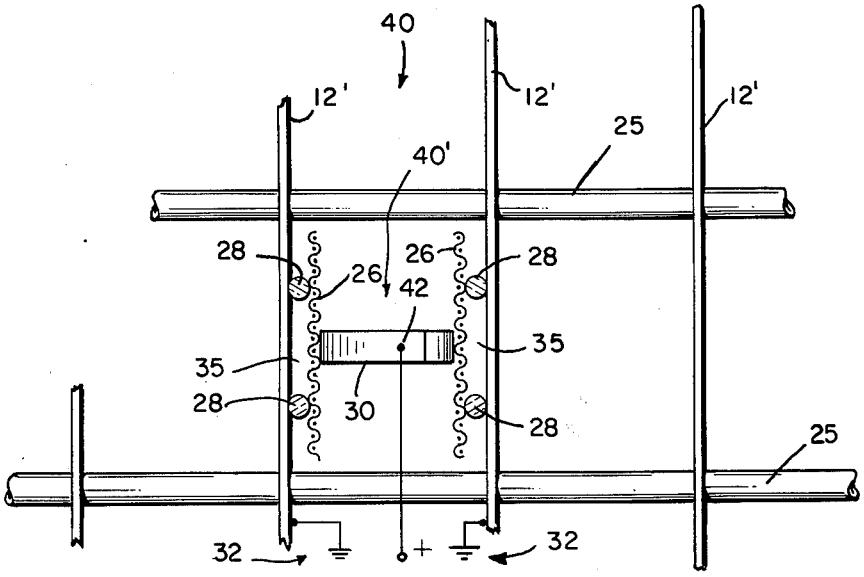

MEANS FOR SENSING FROST ACCUMULATION IN A REFRIGERATION MECHANISM

BACKGROUND OF THE INVENTION

Generally speaking, the present invention relates to refrigeration mechanisms such as those usually found in refrigerators and the like and more specifically to refrigeration mechanisms which include a refrigerant; a means for pressurizing the refrigerant, a means for liquifying the refrigerant, a means for vaporizing the refrigerant; and a means for circulating air to be refrigerated wherein the improvement comprises a means for sensing actual frost accumulation within the refrigeration mechanism.

In most "frost-free" refrigerators the time at which the defrost mechanism turns-on is either preselected or a function of the temperature within the refrigeration compartment and accordingly it in fact does not operate as a direct function of the actual accumulation of frost within the refrigeration mechanism itself. Accordingly, in many instances defrost mechanisms function more frequently than is necessary to maintain substantially "frost-free" conditions in a refrigeration compartment thereby resulting in the inefficient utilization of power.

Relying upon the principle that the dielectric constant of ice is considerably greater than that of air the present invention provides a means for sensing frost accumulation within a refrigeration mechanism which employs a capacitance sensitive element. The above stated principle and its application to the detection of the presence of ice is not new e.g. see Hoenisch et al Patent issued Jan. 2, 1968 (U.S. Pat. No. 3,360,951) and Dow Patent issued July 24, 1962 (U.S. Pat. No. 3,046,537). However, the present invention applies the principle to the sensing of frost accumulation in a refrigeration mechanisms. One of the primary difficulties in employing a capacitance sensitive element in an environment where ice or frost is allowed to actually accumulate on the electrodes of such element is the deformation of the electrodes. This deformation results from the contraction and expansion associated with the freezing and melting processes. Naturally, as the electrodes are deformed the capacitance value of the capacitance sensitive element will vary resulting in a capacitance sensitive element which senses unpredictable amounts of accumulated frost.

SUMMARY OF THE INVENTION

Accordingly, it is a feature of the present invention to provide a means for sensing actual frost accumulation in a refrigeration mechanism which includes a refrigerant, a means for pressurizing the refrigerant, a means for liquifying the refrigerant, a means for vaporizing the refrigerant, and a means for circulating air to be refrigerated. Another feature of the present invention is to provide a means for sensing frost in a refrigeration mechanism which is a capacitance sensitive element. Another feature of the present invention is to provide a means for sensing frost in a refrigeration mechanism which is a function of actual accumulation of frost within the refrigeration mechanism. Yet another feature of the present invention is to provide a capacitance sensitive element which senses frost in a refrigeration mechanism by the accumulation of the frost on its electrodes. Still yet another feature of the present invention is to provide a capacitance sensitive element which senses actual frost accumulation in a refrigeration mechanism wherein a means for sustaining the fixed spatial relationship between the electrodes of the capacitance sensitive element maintains a substantially constant capacitance value under no-frost conditions. Still anothr feature of the present invention is to provide a capacitance sensitive element for sensing the actual accumulation of frost in a refrigeration mechanism wherein at least a portion of the means for vaporizing the refrigerant comprises at least one electrode of the capacitance element.

These and other features of the invention will become more apparent from the following description taken in conjunction with the accompanying drawings which follow:

BRIEF DESCRIPTION OF THE DRAWINGS

FIG. 1 is a schematic view shown in perspective of a refrigeration mechanism.

FIG. 2 is a sectional view of a capacitance sensitive element taken along lines 2—2 of FIG. 1.

DESCRIPTION OF THE PREFERRED EMBODIMENT

Figure 3:
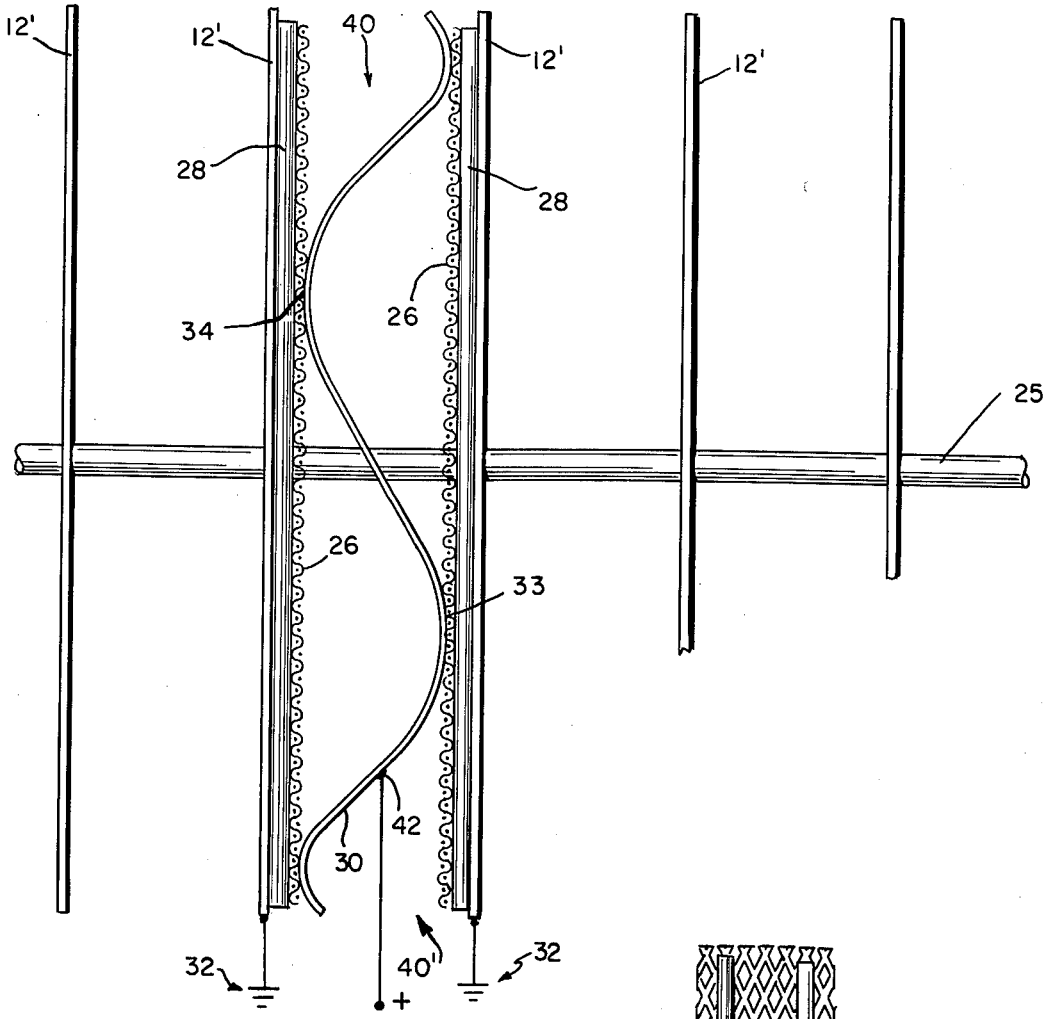
FIG. 3 is a sectional view of a capacitance sensitive element taken along lines 3—3 of FIG. 1.

Referring to FIG. 1, a refrigeration mechanism 10 is housed in a refrigeration compartment 11 and includes a refrigerant 18 which is carried by tubes 22 and 24, a means 16 for pressurizing the refrigerant 18, a means 20 for liquifying the refrigerant 18, a means 12 for vaporizing the refrigerant 18, a means 14 for circulating the air to be refrigerated, and a means 40 disposed within the means 12 for vaporizing the refrigerant 18 for sensing the actual accumulation of frost in refrigeration mechanism 10.

In the operation of refrigeration mechanism 10, pressurizing means 16 which in the preferred embodiment is a compressor 16' causes a refrigerant 18 which is a vapor 18' to travel from vaporizing means 12 through tube 24 at low pressure to liquifying means 20 at high pressure. Liquifying means 20 in the preferred embodiment is a condenser 20'. Liquifying means 20 changes vapor refrigerant 18' to a liquid 18'' as heat is transferred to the environment surrounding the refrigeration compartment 11. The liquid refrigerant 18'' is then reduced in pressure by an expansion means 19 which may comprise a capillary or expansion valve contained within tube 22 and enters vaporizing means 12 through tube 22 where the liquid refrigerant 18'' is vaporized, thereby absorbing heat from the air to be refrigerated within refrigeration compartment 11. Vaporizing means 12 includes a plurality of fixed aluminum cooling fins 12' which are coupled to evaporator coils 25 whereby the liquid refrigerant 18'' is carried through vaporizing means 12 and vaporized. The air to be refrigerated within refrigeration compartment 11 is circulated through vaporizing means 12 and over metal cooling fins 12' by a means 14 for circulating the air which in the preferred embodiment is a fan 14'. Since vaporizing means 12 is the coldest part of refrigeration mechanism 10, as the air within refrigeration compartment 11 is circulated through vaporizing means 12 moisture from the air condenses and accumulates on the metal cooling fins 12' in the form of frost. In refrigeration mechanism 10 this frost accumulation is sensed by frost sensing means 40 which is disposed within vaporizing means 12.

At predetermined levels of frost accumulation the normal functions of refrigeration mechanism 10 may be stopped and heat applied to vaporizing means 12 to melt the frost.

Figure 4:
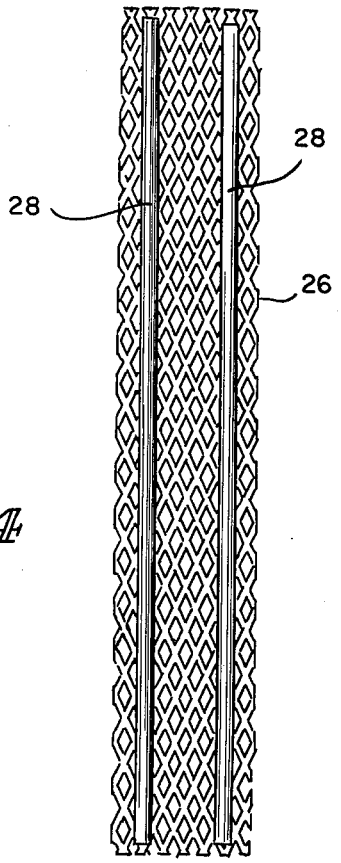
FIG. 4 is an elevation view of a perforated metal plate.

Referring to FIGS. 2 and 3, frost sensing means 40 is a capacitance sensitive element 40' and more specifically a capacitor. As shown in the preferred embodiment at least one metal cooling fin 12' of vaporizing means 12 comprises at least one electrode of capacitance sensitive element 40'; however, in general it is only necessary that at least one electrode of the capacitance sensitive element 40' be thermally coupled to metal cooling fins 12' so that frost may accumulate on the electrode. Another electrode of capacitance sensitive element 40' includes two perforated stainless steel plates 26 which are inserted between two metal cooling fins 12' of vaporizing means 12 in spaced parallel relationship to the fins 12', and a means 30 for sustaining the fixed spatial relationship. Each metal cooling fin 12' and metal plate 26 are separated by two insulating spacers 28 which may be comprised of a ceramic material or any other insulating material. The spacers 28 are coupled longitudinally along the edges of each metal plate 26. FIG. 4 is an elevated view of a perforated metal plate 26 showing the disposition of the spacers 28.

The metal plates 26 with the spacers 28 coupled thereto are pressed against the metal cooling fins 12' by sustaining means 30. Sustaining means 30 includes a stainless steel spring which is a flexible ribbon. Sustaining means 30 is coupled to several points 33 and 34 of each of the metal plates 26 such that by pressing the two metal plates 26 together the whole assembly comprising metal plates 26, sustaining means 30, and insulating means 28 may be inserted between the metal cooling fins 12'. Upon releasing the pressure, the metal plates 26 are held in position by friction due to the force applied by sustaining means 30. The metal cooling fin 12' of vaporizing means 12 are typically at zero potential as a result of a means 32 for grounding refrigeration mechanism 10. Accordingly by making electrical contact with metal plates 26 at a contact point 42 a capacitance measurement can be made between the metal plate 26 and the metal cooling fins 12' which are at ground potential.

In the operation of frost sensing means 40, moisture laden air to be refrigerated within refrigeration compartment 11 is circulated between the metal cooling fins 12' of vaporizing means 12 and through the perforations of metal plates 26 by a fan 14'. Moisture from the air condenses between the metal cooling fins 12' and at the same time in the space 35 between the metal plates 26 and the metal cooling fins 12'. As the moisture condenses, frost accumulates in the space 35 between metal plates 26 and the metal cooling fin 12' which will cause an increase in the capacitance of capacitance sensitive element 40'. Accordingly, by making electrical contact to capacitance sensitive element 40' at contact point 42 the accumulation of frost in refrigeration mechanism 10 and more particularly in vaporizing means 12 may be sensed. As the accumulation of frost increases the capacitance of capacitance sensitive element 40' will also increase.

What is claimed is:

1. In a refrigeration mechanism including a refrigerant and means for vaporizing said refrigerant having at least two metal fins for absorbing heat, the improvement comprising a capacitance sensitive element for sensing actual frost accumulation within said refrigeration mechanism wherein said capacitance sensitive element is disposed within said means for vaporizing said refrigerant, portions of said two metal fins of said means for vaporizing said refrigerant comprise one electrode of said capacitance sensitive element, and two metal plates are frictionally retained between said portions of said two metal fins and separated therefrom by insulating spacers whereby a capacitance may be established between said plates and said portions of said fins.

2. The refrigeration mechanism as recited in claim 1 wherein said metal plates are perforated.

3. The refrigeration mechanism as recited in claim 2 wherein a means for sustaining said plates and said portions of said fins in fixed spatial relationship is attached to at least one point of each of said plates.

4. The refrigeration mechanism as recited in claim 3 wherein said means for sustaining said fixed spatial relationship and said metal plates comprise another electrode of said capacitance sensitive element.

5. The refrigeration mechanism as recited in claim 3 wherein said means for sustaining said fixed spatial relationship includes a metal spring.

6. The refrigeration mechanism as recited in claim 5 wherein said metal spring comprises a flexible ribbon.

7. The refrigeration mechanism as recited in claim 6 wherein said capacitance sensitive element is a capacitor.

8. A method for sensing frost accumulation in a refrigeration mechanism comprising the steps of circulating humid air to be refrigerated through a vaporizing means, absorbing heat from said air through at least two metal fins thermally coupled to said vaporizing means, frictionally retaining two metal plates between said two metal fins in spaced parallel relation to said fins thereby forming two electrodes of a capacitance sensitive element, condensing moisture from said air thereby forming frost, and accumulating said frost between said plates and fins whereby a change in capacitance may be sensed.

9. The method as recited in claim 8 wherein said metal plates are perforated whereby said air is circulated through said metal plates and between said electrodes.

10. The method as recited in claim 8 further comprising the step of sustaining a fixed spatial relationship between said electrodes whereby said relationship is substantially constant during frost and defrost conditions.

11. The method as recited in claim 10 wherein said fixed spatial relationship is sustained by a flexible metal ribbon comprising a spring and by insulating spacers.

12. The method as recited in claim 11 wherein said spring and said spacers are attached to at least one of said electrodes.

13. In a refrigeration mechanism including a refrigerant, means for vaporizing said refrigerant, and a means for circulating air to be refrigerated, the improvement comprising a capacitance sensitive element for sensing actual frost accumulation disposed within said means for vaporizing said refrigerant wherein portions of at least two metal fins of said means for vaporizing said refrigerant comprise at least one electrode of said capacitance sensitive element and at least two metal plates in spaced parallel relation to said portions of said metal fins comprise at least another electrode of said capacitance sensitive element, at least one of said metal plates having perforations therethrough whereby said air is circulated through said metal plate and between said electrodes.

14. A method for sensing frost accumulation in a refrigeration mechanism comprising the steps of circulating humid air to be refrigerated through a vaporizing means, absorbing heat from said air in proximity of said vaporizing means, condensing moisture from said air thereby forming frost, and accumulating said frost on electrodes of a capacitance sensitive element which include portions of at least two metal fins of said vaporizing means and at least two perforated metal plates in spaced parallel relation to said portions of said metal fins whereby said air is circulated through said metal plates and between said electrodes and upon accumulation of said frost a change in capacitance is sensed.

* * * * *